US011493014B2

(12) United States Patent
Rhoades

(10) Patent No.: US 11,493,014 B2
(45) Date of Patent: Nov. 8, 2022

(54) RELUCTOR PLATE CONTROLLER

(71) Applicant: John C. Rhoades, Fort Collins, CO (US)

(72) Inventor: John C. Rhoades, Fort Collins, CO (US)

( * ) Notice: Subject to any disclaimer, the term of this patent is extended or adjusted under 35 U.S.C. 154(b) by 0 days.

(21) Appl. No.: 17/227,537

(22) Filed: Apr. 12, 2021

(65) Prior Publication Data

US 2021/0340929 A1 Nov. 4, 2021

Related U.S. Application Data

(60) Provisional application No. 63/019,160, filed on May 1, 2020.

(51) Int. Cl.

| | |
|---|---|
| ***F02P 5/15*** | (2006.01) |
| ***F02D 41/26*** | (2006.01) |
| ***F02P 5/07*** | (2006.01) |
| ***F02P 5/12*** | (2006.01) |
| ***F02P 5/04*** | (2006.01) |
| ***F02D 41/28*** | (2006.01) |
| ***F02D 41/00*** | (2006.01) |
| ***F02P 7/02*** | (2006.01) |

(52) U.S. Cl.

CPC ..... *F02P 5/15* (2013.01); *F02D 41/26* (2013.01); *F02P 5/04* (2013.01); *F02P 5/075* (2013.01); *F02P 5/12* (2013.01); *F02P 5/1502* (2013.01); *F02D 41/0002* (2013.01); *F02D 41/28* (2013.01); *F02D 2041/285* (2013.01); *F02D 2200/0404* (2013.01); *F02P 7/022* (2013.01)

(58) Field of Classification Search

CPC ..... F02P 5/15; F02P 5/04; F02P 5/075; F02P 5/12; F02P 5/1502; F02P 7/022; F02P 5/005; F02D 41/26; F02D 41/0002; F02D 41/28; F02D 2041/285; F02D 2200/0404

USPC ..... 123/406.73, 117, 406.67, 595

See application file for complete search history.

(56) References Cited

U.S. PATENT DOCUMENTS

| | | | | | |
|---|---|---|---|---|---|
| 1,897,704 | A * | 2/1933 | Mallory | F02P 5/145 | 123/406.74 |
| 2,394,792 | A * | 2/1946 | MacMillan | F02P 5/103 | 123/406.67 |
| 3,561,410 | A * | 2/1971 | Soeters | F02P 5/106 | 92/99 |
| 3,596,643 | A * | 8/1971 | Schweitzer | F02D 29/00 | 123/406.23 |
| 3,665,904 | A * | 5/1972 | Goodwillie | F02P 5/103 | 123/406.7 |

(Continued)

FOREIGN PATENT DOCUMENTS

| | | | | |
|---|---|---|---|---|
| GB | 1356013 A * | 6/1974 | F01N 3/18 | |
| GB | 1427361 A * | 3/1976 | F02P 5/1556 | |
| JP | 02230957 A * | 9/1990 | | |

*Primary Examiner* — Sizo B Vilakazi
*Assistant Examiner* — Brian R Kirby
(74) *Attorney, Agent, or Firm* — William W. Cochran; Cochran Freund & Young, LLC

(57) ABSTRACT

Disclosed is a reluctor plate controller that detects vacuum and pressures in the engine which are used to create digital motor control signals for controlling a reluctor plate actuator using a digital stepper motor, servo motor or a voice-coil actuator. The system can be programmed to create various desired responses that function to create better efficiency of an internal combustion engine, less pollution and/or greater engine output.

18 Claims, 5 Drawing Sheets

(56) References Cited

U.S. PATENT DOCUMENTS 3,738,339 A * 6/1973 Huntzinger ..... F02P 5/1551 123/406.63
3,763,420 A * 10/1973 Maisonville ..... G06F 7/62 324/392
3,779,218 A * 12/1973 Nambu ..... F02P 5/1558 123/406.67
3,785,356 A * 1/1974 Niemoeller ..... F02P 5/1556 123/406.19
3,788,290 A * 1/1974 Carter ..... F02P 5/1558 123/406.67
3,791,357 A * 2/1974 Cook ..... F02P 5/1556 123/406.51
3,792,630 A * 2/1974 Hause ..... B60W 10/06 477/109
3,810,451 A * 5/1974 Fales ..... F02P 5/1556 123/406.55
3,927,648 A * 12/1975 Kawai ..... F02P 5/15 123/406.63
3,969,614 A * 7/1976 Moyer ..... F02D 41/26 123/480
3,978,831 A * 9/1976 Yoshikawa ..... F02P 5/106 123/406.55
4,023,359 A * 5/1977 Masaki ..... F01N 3/22 60/285
4,052,967 A * 10/1977 Colling ..... F02P 3/0456 123/406.6
4,084,240 A * 4/1978 Lappington ..... F02D 41/2425 123/480
4,106,448 A * 8/1978 Noguchi ..... F02P 5/15 60/285
4,116,175 A * 9/1978 Sand ..... F02P 5/1455 123/406.42
4,151,818 A * 5/1979 Tateno ..... F02P 5/103 123/406.68
4,158,350 A * 6/1979 Moller ..... F02P 5/1555 318/609
4,161,926 A * 7/1979 Vogel ..... F02M 7/11 123/437
4,211,194 A * 7/1980 Hattori ..... F02P 5/1522 123/406.42
4,231,091 A * 10/1980 Motz ..... F02P 3/0456 123/406.65
4,256,072 A * 3/1981 Nakatomi ..... F02P 5/1512 123/406.63
4,271,797 A * 6/1981 McCarbery ..... F02D 41/04 73/114.37
4,324,216 A * 4/1982 Johnson ..... F02P 15/008 123/406.13
4,346,686 A * 8/1982 Wakita ..... F02M 3/07 123/339.11
4,354,238 A * 10/1982 Manaka ..... F02D 41/26 123/480
4,416,234 A * 11/1983 Ikeura ..... F02P 5/1506 123/406.55
4,417,563 A * 11/1983 Brodie ..... F02P 3/0884 123/607
4,450,808 A * 5/1984 Moriyama ..... F02P 5/1516 123/406.48
4,479,186 A * 10/1984 Takao ..... F02D 41/26 123/480
4,512,310 A * 4/1985 Haraguchi ..... F02P 5/1522 73/35.03
4,524,745 A * 6/1985 Tominari ..... F02D 43/00 123/406.47
4,532,902 A * 8/1985 Mizuno ..... F02P 5/1504 123/406.47
4,608,955 A * 9/1986 Ohtaki ..... F02P 5/1516 123/406.48
4,805,574 A * 2/1989 Sakamoto ..... F02P 5/1528 123/406.55
4,831,983 A * 5/1989 Day ..... F02D 41/407 123/372
4,987,871 A * 1/1991 Nishikawa ..... F02D 41/061 123/588
5,842,457 A * 12/1998 Terakado ..... F02P 7/026 123/613
7,267,105 B1 * 9/2007 Chamblin ..... F02P 5/1502 123/406.59
2003/0075159 A1 * 4/2003 Vamvakitis ..... F02M 26/60 123/568.21
2005/0039731 A1 * 2/2005 Bittner ..... F02P 7/03 123/595
2008/0279163 A1 * 11/2008 Desai ..... H04W 72/1215 370/328
2013/0085626 A1 * 4/2013 Leggett ..... B60R 25/045 701/2
2017/0120915 A1 * 5/2017 David ..... F16H 61/6648

* cited by examiner

RELUCTOR PLATE CONTROLLER

CROSS-REFERENCE TO RELATED APPLICATION

This Non-Provisional patent application claims the benefit of the U.S. Provisional Patent Application No. 63/019,160, entitled "Reluctor Plate Controller," which was filed with the U.S. Patent & Trademark Office on May 1, 2020, which is specifically incorporated herein by reference for all that it discloses and teaches.

BACKGROUND

Internal combustion engines having ignition distributors for distributing sparks to multiple cylinders have been used for various purposes, including automobiles, marine applications, airplanes, generators and many other applications, for a number of years. Ignition distributors function to distribute the spark at a specific time to spark plugs to multiple cylinders. The timing of the spark can be important in controlling various types of emissions created by internal combustion engines, as well as affecting engine efficiencies, engine performance and other factors. Prior systems have used mechanical systems that consist of diaphragms contained in sealed compartments that are biased with springs that control spark advancement based upon vacuum or pressure created in various parts of the engine. These types of mechanical systems have a limited lifetime and become less accurate and inoperable over a period of time.

SUMMARY

The present invention may therefore comprise a method of controlling positions of a reluctor plate in a distributor for an internal combustion engine comprising: detecting pressure or vacuum created by the internal combustion engine; generating an electrical sensor signal representative of the pressure or vacuum; generating an electrical control signal using a logic device, the electrical control signal generated in response to the electrical sensor signal and used to control a mechanical actuator; using the mechanical actuator to control the positions of the reluctor plate in the distributor in response to the control signal.

The present invention may further comprise a system for controlling positions of a reluctor plate in a distributor for an internal combustion engine comprising: at least one sensor that detects vacuum or pressure created by the internal combustion engine and generates sensor signals; a memory that stores control data; a logic device, coupled to the memory, that reads the sensor signals and generates a logic signal based upon the sensor signals and the control data stored in the memory; a digital control signal generator that generates a digital control signal in response to the logic signal; a mechanical actuator, that is mechanically coupled to the reluctor plate, that moves the reluctor plate in response to the digital control signal.

DETAILED DESCRIPTION OF THE EMBODIMENTS

Figure 1:
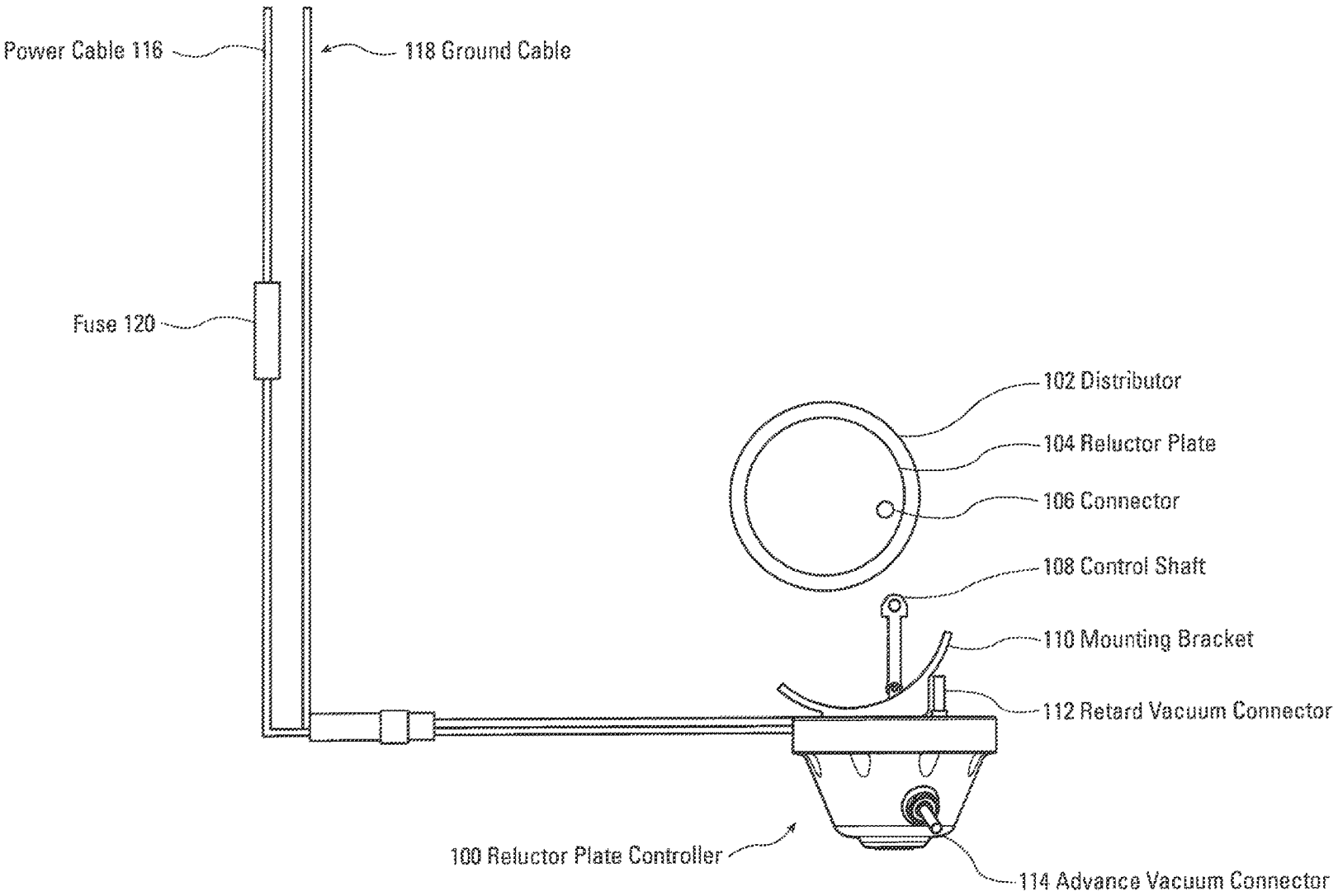
FIG. 1 is a schematic illustration of the implementation of a reluctor plate controller.

FIG. 1 is a schematic diagram that discloses the manner in which a reluctor plate controller 100 is used in an internal combustion engine. Older internal combustion engines utilize distributors, such as distributor 102, that control the timing of the spark to multiple cylinders. Ignition distributors, such as illustrated in FIG. 1, utilize weights that control the rotation of the distributor based upon the RPMs of the engine which changes the timing of the spark. The distributor has a central shaft that that is geared to the engine drive train so that the central shaft of the distributor rotates at a speed that is linearly proportional to the RPMs of the engine in which the distributor is disposed. As the RPMs of the engine increases, the central shaft of the distributor increases. Weights connected to the central shaft of the distributor create a centripetal force that causes the distributor to rotate which varies the timing of the spark that is distributed to the various cylinders, since the advancement needed for the spark is greater at higher RPMs of the engine.

Separate and distinct from the advancement of the distributor by the centripetal weights is the advancement required when the throttle position is changed. A change in throttle position changes the vacuum/pressure at various locations at the intake of the engine. For example, the vacuum or pressure in the throttle body changes at both the pre-throttle location and the post-throttle location. Further, the vacuum or pressure in various parts of the intake manifold also change. To obtain proper advancement for both efficiency of the engine and to reduce emissions, it has been determined that advancement of the spark in the distributor based upon pressure or vacuum at various locations can positively affect both the efficiency of the engine and reduce pollution emitted by the engine. These changes in vacuum and/or pressure essentially function to accurately predict the RPMs of the engine that will exist after a short-delayed period of a few seconds. In addition, the change in pressure and/or vacuum can be used to provide a fine adjustment to the advancement or retardation of the spark that is distributed to the various cylinders to provide a finer, higher resolution adjustment of the spark advancement or retardation to more accurately control the efficiency, power and pollution effects of the internal combustion engine.

In previous systems, a mechanical diaphragm was used with either one or two vacuum hoses connected to desired locations in the throttle body and/or intake manifold. Depending on the pressure or vacuum that was transmitted to the diaphragm chamber, the diaphragm moved with the assistance of springs to control an arm that then moved a reluctor plate in the distributor. The reluctor plate in the distributor functions to more finely adjust the spark advance or retardation that is not otherwise provided by the centripetal weights in the distributor. Reluctor plates are also referred to as trigger plates or crankshaft timing sensor plates and function, in general, to control the generation of spark pulses using breaker points and a condenser, magnetic pulse generation and optical pulse generation. As used herein, the term "reluctor plate" includes all of the above-described mechanisms. These older mechanical systems that use diaphragms and springs are inaccurate and unable to provide a precise response to the vacuum or pressures used to control the diaphragm. Springs can be selected to vary the response of the mechanical diaphragm devices, but provide very little ability to change the response curves. The ability to control the advancement or retardation by controlling the position of the reluctor plate based upon vacuum and/or pressure readings from various parts of the engine and the ability to program the response, creates a system in which a high degree of precision and accuracy can be achieved to control the efficiency, power and pollution output of the internal combustion engine. That accuracy is achieved using the reluctor plate controller 100 of the present invention.

Referring again to FIG. 1, electrical power is provided by power cable 116 which is connected to fuse 120. Electrical power is then transmitted to the reluctor plate controller 100 to provide power to operate the various electrical components of the reluctor plate controller 100. Similarly, ground cable 118 provides a ground connection to the reluctor plate controller 100. The distributor 102 has a reluctor plate 104 that rotates within the distributor and has a connector 106 that connects to the control shaft 108. Control shaft 108 moves in response to the controls generated by the reluctor plate controller 100. The reluctor plate controller 100 may have a retard vacuum connector 112 and an advance vacuum connector 114. These connectors are connected to vacuum hoses which are also connected at various locations in the throttle body and/or intake manifold. Although both a retard vacuum connector 112 and advance vacuum connector 114 are illustrated, a single vacuum connector or pressure connector may be utilized to achieve similar results. The use of both the retard vacuum connector 112 and an advanced vacuum controller 114 allow connection to a differential pressure vacuum sensor 128 (FIG. 2) to provide a very accurate control pressure and/or vacuum reading. The control shaft 108 is inserted through an opening in the distributor 102 and connects to the connector 106 on the reluctor plate 104. Mounting bracket 110 is designed to mount the reluctor plate controller 100 directly on the distributor 102.

Figure 2:
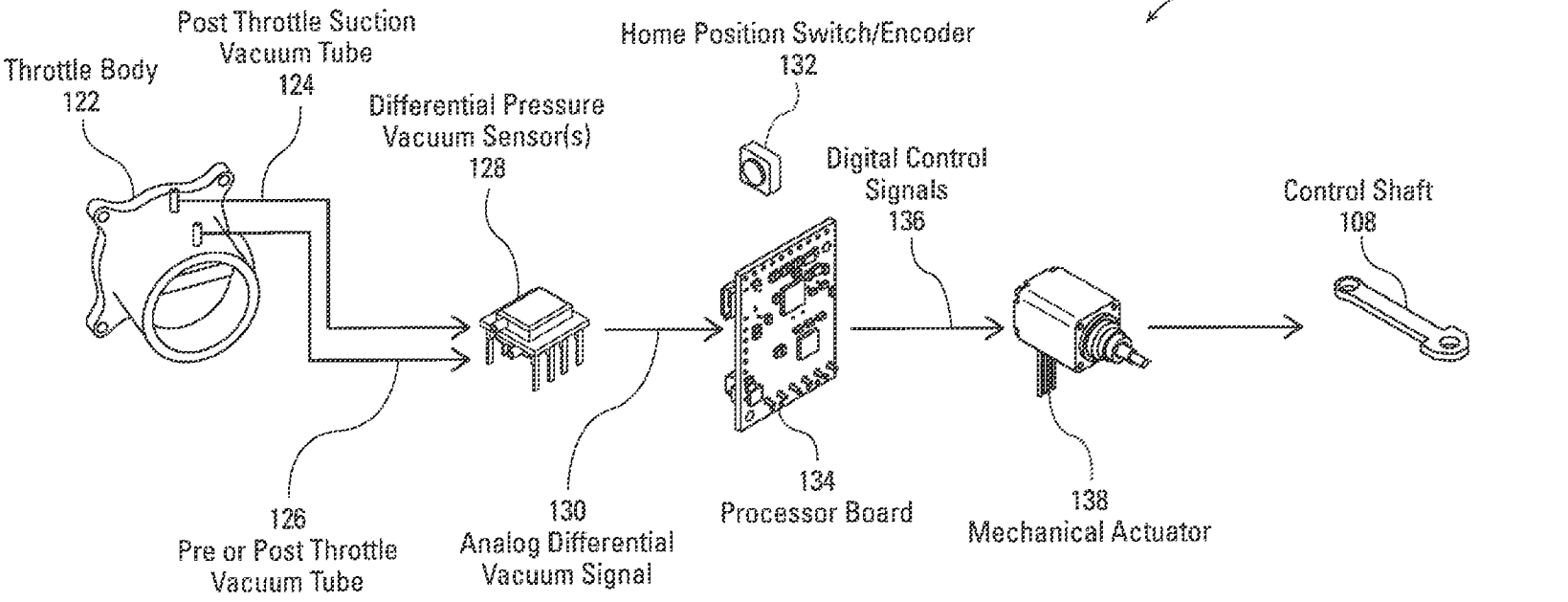
FIG. 2 is a schematic diagram of a reluctor plate controller illustrated in the embodiment of FIG. 1.

FIG. 2 is a schematic diagram of an embodiment illustrating the manner in which the reluctor plate controller 100 may be implemented with ports on a throttle body 122. As illustrated in FIG. 2, a post throttle suction vacuum tube 124 is connected to the throttle body 122 between the throttle and the intake manifold on the throttle body 122. Pre- or post-throttle vacuum tube 126 can be connected to a port on the opposite side of the throttle on the throttle body 122, as illustrated in FIG. 2, or other location on the other side of the throttle, such as on the intake manifold. The location of the connectors to obtain a desired vacuum and/or pressure is normally determined by the engine manufacturer. The engine manufacturer determines the ideal location for detecting vacuum and/or pressure depending upon the engine configuration. For example, the throttle body 122 in some implementations may be connected to a supercharger or a turbocharger. These devices create high pressures that are applied to the throttle body 122. In such an implementation, it may, or may not be advantageous to determine the pressure at a pre-throttle location.

As also shown in FIG. 2, the post throttle suction vacuum tube 124 and the pre- or post-throttle vacuum tube 126 are connected to the differential pressure vacuum sensors 128. The differential pressure vacuum sensors 128 determine the difference in pressure and/or vacuum between the tubes 124, 126 and generates an analog differential vacuum signal 130. Alternatively, some implementations only require a single vacuum and/or pressure tube. In those cases, the differential pressure vacuum sensors 128 simply generate an analog differential vacuum signal 130 from the single pressure and/or vacuum detected by a single tube. The analog differential vacuum signal 130 is applied to a processor board 134. The processor board is also connected to a home position switch or encoder 132 that generates a signal that is representative of a home position for the control shaft 108. The processor board 134 may include an analog to digital converter 164 (FIG. 4) which creates a digital or binary signal from the analog differential vacuum signal 130 and also for the home position switch or encoder 132, in the instances when the home position switch or encoder 132 generates an analog signal. The processor board 134 also includes a microprocessor, state machine or other logic device and programmable storage such as EPROM or EEPROM or flash memory for storing response curves for a desired response of the system, as disclosed in more detail with respect to FIG. 2. The processor generates control signals which are transmitted to a digital control signal generator 172 (FIG. 4) located on the processor board 134. The digital control signal generator 172 (FIG. 4) generates digital control signals 136 that are then transmitted to a mechanical actuator 138. The mechanical actuator can comprise a linear digital stepper motor, a linear servo motor or a voice-coil actuator to control the movement and positioning of control shaft 108 in a very precise manner. Processor board 134 may have an I/O port 176 (FIG. 4) which allows the processor board 134 to be programmed to provide various different responses to the analog differential vacuum signal 130. As such, various response curves can be stored in EPROM, EEPROM, flash memory or any type of programmable memory on the processor board 134 to create the desired response for advance or retardation of the spark. The programmable advance or retardation can be used for various purposes including changes in engine efficiency, pollution control and output torque of the internal combustion engine. The mechanical actuator 138 generates a very precise output that controls the position of the control shaft 108 with high precision. Control shaft 108, which is connected to the reluctor plate 104, as illustrated in FIG. 1, can then be controlled with a high degree of precision and in a specific manner desired by the user by adjusting response curves that are stored in the memory modules on the processor board 134.

Figure 3:
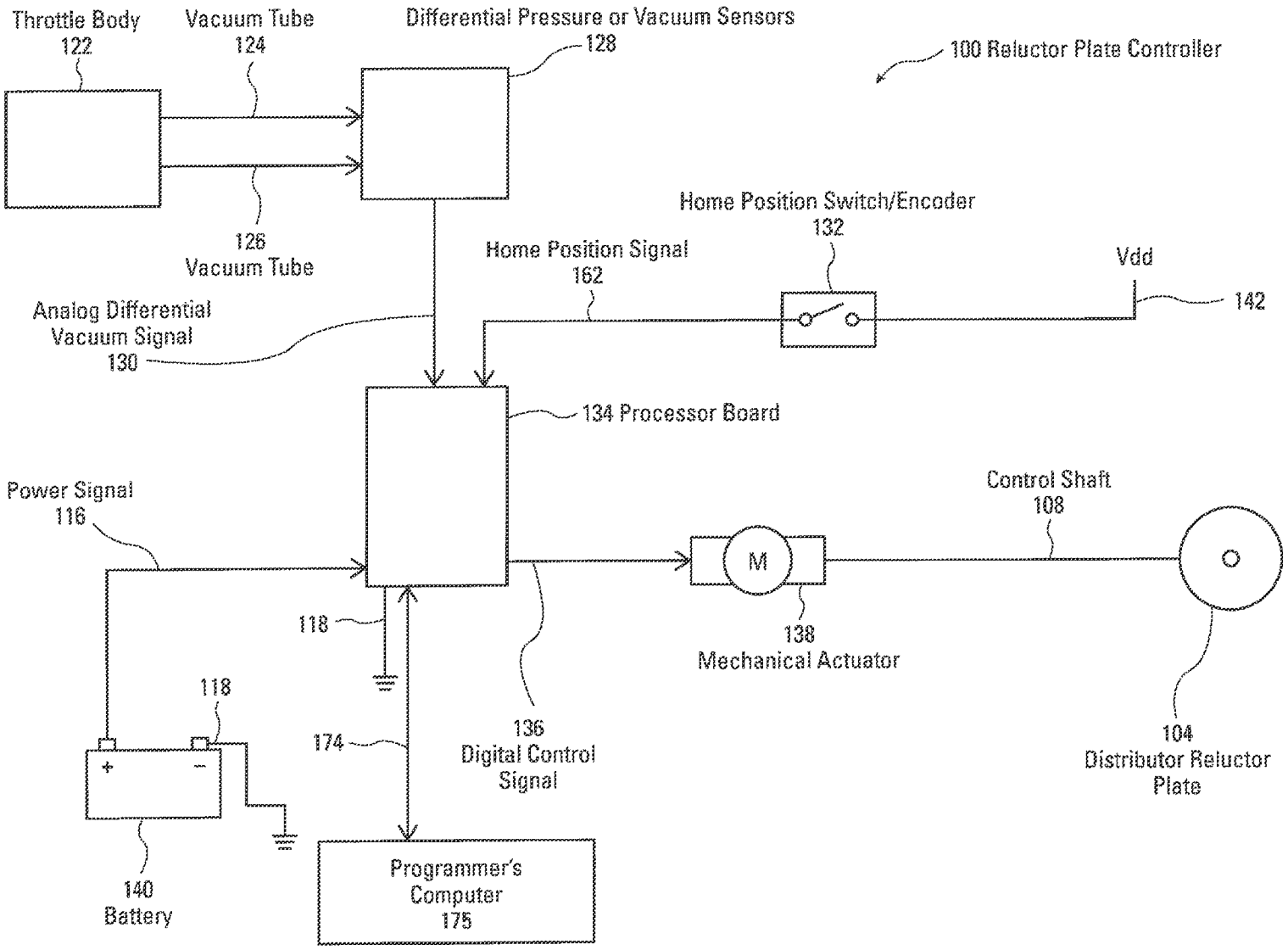
FIG. 3 is a schematic block diagram of a reluctor plate controller illustrated in FIG. 2.

FIG. 3 is a schematic block diagram that describes the operation and function of the reluctor plate controller 100. As illustrated in FIG. 3, throttle body 122 or the intake manifold is connected to one or two vacuum or pressure tubes 124, 126 (herein after referred to as vacuum tubes). The vacuum tubes 124, 126, in turn, are connected to differential pressure or vacuum sensors 128. The differential pressure or vacuum sensors 128 create an analog differential vacuum or pressure signal 130 (herein after referred to as analog differential vacuum signal 130) which is applied to the processor board 134. A home position switch or encoder 132 also provides a home position signal 162 to the processor board 134. The home position switch or encoder 132 can provide a voltage signal Vdd to the processor board 134 at start up, such as upon activation of an ignition switch, that sets the processor and the mechanical control shaft 108 at an initial position. Alternatively, an encoded signal can be transmitted to the processor board 134 upon activation of the ignition switch. A power signal 116 from battery 140 is also applied to the processor board 134 to operate the electrical devices on the processor board 134. The processor board 134 and the battery 140 are connected to ground connectors 118. A processor board 134 may include an analog to digital converter that converts the analog signals, such as the analog differential vacuum signal 130, into a digital or binary signal. Processor board 134 may also include a microprocessor, state machine, or other logic device, for controlling the operations preformed on the processor board 134. Storage devices are also included on the processor board 134, such as programmable storage 168 (FIG. 4), including EPROMs or EEPROMs, flash memory or similar devices. A digital control signal generator 172 (FIG. 4) that generates the digital control signal 136 is mounted on the processor board 134. The digital control signals generated by the digital control signal generator 172 (FIG. 4) are applied to a mechanical actuator 138 such as a digital stepper motor, a servo motor or a voice-coil actuator. This is all disclosed in more detail with respect to FIG. 4. The logic device 166 (FIG. 4) on the processor board 134 retrieves stored response curves that are applied to the digital control signal generator 172 (FIG. 4) on the processor board 134, which in turn generates the digital control signal 136, in accordance with the stored response curves in the storage modules on the processor board 134. The mechanical actuator 138 precisely controls a control shaft 108 that is connected to the distributor reluctor plate 104. Precise control of the distributor reluctor plate 104 is achieved by precise movement of the control shaft 108. Highly precise movement is created by mechanical actuator 138, which may comprise a digital stepper motor, a servo motor, a voice-coil actuator 138 or similar device that is controlled with a high degree of precision. In this manner, the distributor reluctor plate 104 can be controlled very accurately and in a manner that corresponds to a stored actuation response on the processor board 134. A programmer computer 175 is also connected to the processor board 134 via connection 174.

Figure 4:
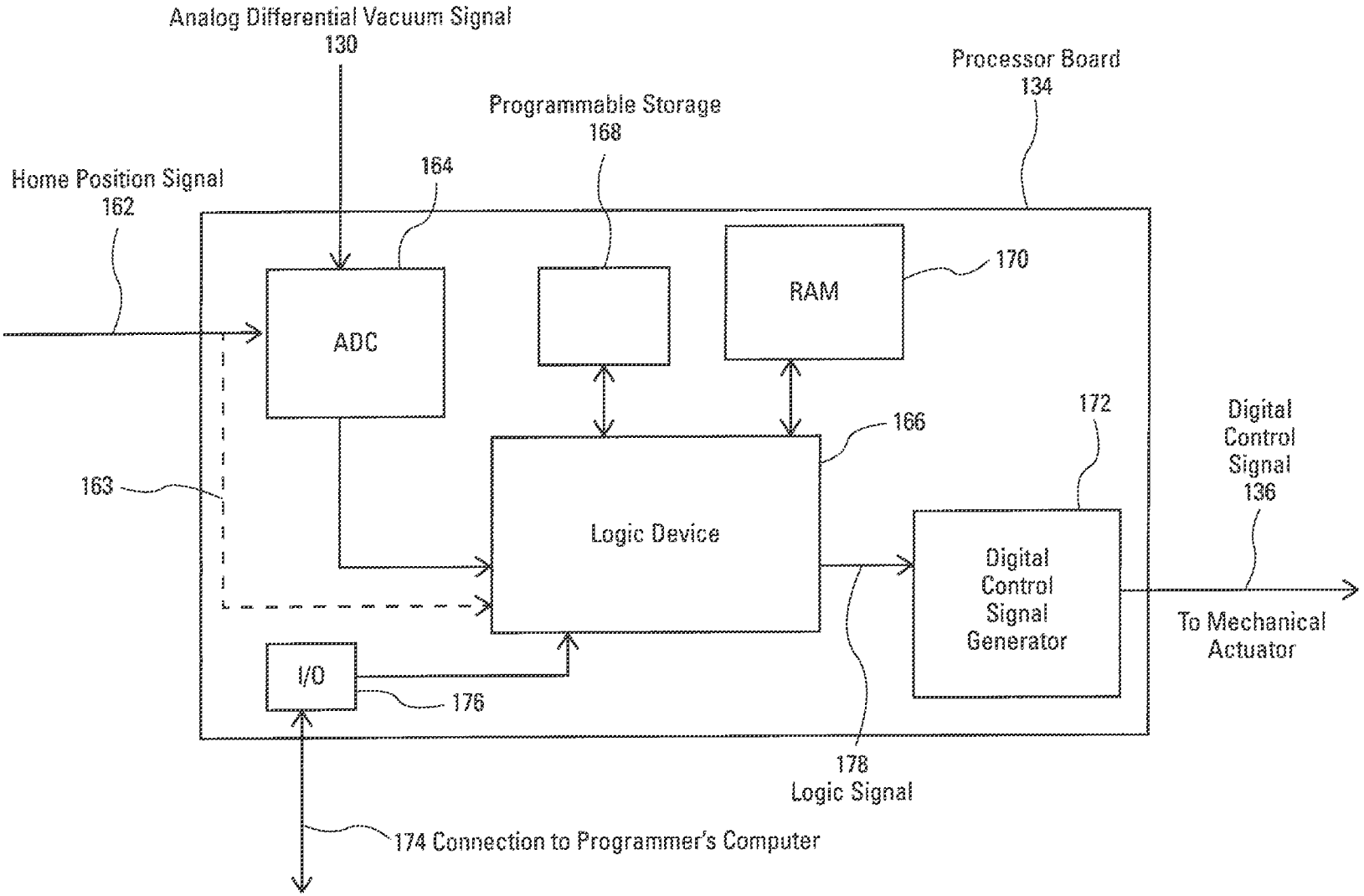
FIG. 4 is a schematic block diagram of an embodiment of a processor board.

FIG. 4 is a more detailed diagram of the processor board 134. As illustrated in FIG. 4, an analog differential vacuum signal 130 is applied to an analog to digital converter 134 on the processor board 134. Analog to digital converter 164 generates a binary signal that is applied to the logic device 166. Logic device 166 may comprise a microprocessor, a state machine or other similar logic device for performing logic functions. A home position signal 162 may also be applied to the analog to digital converter 164 which converts the home position signal 162 into a binary signal. Alternatively, the home position signal 162 may comprise a binary signal that is then applied directly to the logic device 166 via connector 163. An input/output port (1/O port) 176 may be provided on the processor board 134 which allows connection to a programmer's computer 175 via the connection 174. A logic device 166 may be connected to various storage devices, such as programmable storage 168, RAM 170 or ROM memory (not shown). Programmable storage 168 may comprise EPROM, EEPROM, flash memory or other storage memory that can be programed with response curves for the desired output or positioning of the control shaft 108 (FIG. 3). The logic device 166 creates a logic signal 178 that is applied to the digital control signal generator 172. The digital control signal generator 172 is essentially a driver that converts the logic signals into digital control signals 136 which control the mechanical actuator 138 (FIG. 3). The connection of the devices illustrated in FIG. 4 is of schematic nature only. As understood by those skilled in the art, the devices may be connected via a bus which provides an inter-connection between the devices illustrated in FIG. 4. These techniques are well known by those skilled in the art.

Figure 5:
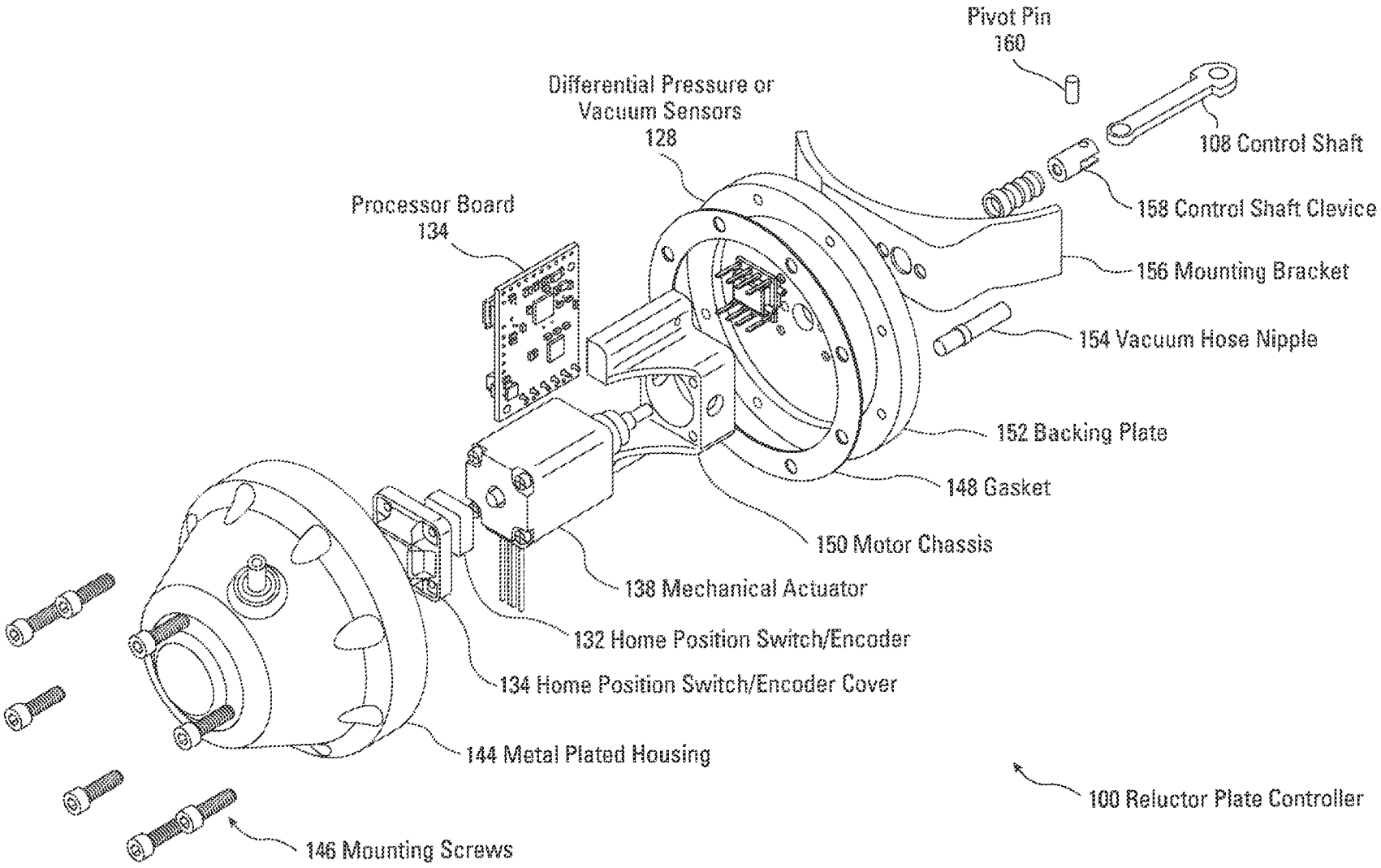
FIG. 5 is an exploded diagram of an embodiment of a reluctor plate controller.

FIG. 5 is an exploded diagram of the reluctor plate controller 100. As illustrated in FIG. 5, the reluctor plate controller 100 includes a metal plated housing 144. The metal plated housing 144 is durable and is grounded which functions to protect the electronics housed within the metal plated housing 144 from electromagnetic interference and electrical pulse signals that may affect the reluctor plate controller 100. The metal plated housing 144 is sealed to the backing plate 152 with gasket 148 to seal out moisture, dust and other contaminants that may affect the mechanical and electrical devices that are housed in a metal plated housing 144. Mounting screws 146 protrude through the metal plated housing 144 and engage the backing plate 152 with threaded holes in the backing plate 152. Inside the metal plated housing 144 is the home position switch or encoder cover 134 and the home position switch or encoder 132. Also enclosed in the housing is the mechanical actuator 138 which may comprise a linear digital stepper motor, a servo motor, a voice-coil actuator, or similar device, that is mounted on motor chassis 150. Processor board 134 is also mounted on the motor chassis 150. Motor chassis 150 is mounted on the backing plate 152. Differential pressure and/or vacuum sensors 128 are also mounted on the backing plate 152. A vacuum hose nipple 154 is press fit into the backing plate 152 and provides at least one connection for a vacuum or pressure hose. Another vacuum or pressure port is also placed on the metal plated housing 144. Mounting bracket 156 is mounted on an opposite side of the backing plate 152. An opening in the mounting bracket 156 and another opening in the backing plate 152 provides a connection between the mechanical actuator 138 that controls the control shaft 108. Control shaft 108 is connected to the shaft of the mechanical actuator 138 with a control shaft clevice 158. Control shaft 108 is inserted in a slot in the shaft clevice 158. A pivot pin 160 is inserted through the control shaft clevice 158 and through an opening in the control shaft 108 to secure the control shaft 108 to the control shaft clevice 158.

Consequently, a highly accurate and high resolution reluctor plate controller 100 is capable of controlling the advance or retardation of sparks that are distributed to spark plugs in multiple cylinders in an internal combustion engine with a high degree of precision not achieved by previous mechanical systems. In addition, the response curves that control the position of control shaft can be programed into the system to achieve various desired results for advancing and retarding the spark of the internal combustion engine which can create greater efficiency of the engine, lower emissions and/or greater power.

The foregoing description of the invention has been presented for purposes of illustration and description. It is not intended to be exhaustive or to limit the invention to the precise form disclosed, and other modifications and variations may be possible in light of the above teachings. The embodiment was chosen and described in order to best explain the principles of the invention and its practical application to thereby enable others skilled in the art to best utilize the invention in various embodiments and various modifications as are suited to the particular use contemplated. It is intended that the appended claims be construed to include other alternative embodiments of the invention except insofar as limited by the prior art.

What is claimed is:

1. A method of controlling positions of a reluctor plate in a distributor for an internal combustion engine comprising:

detecting pressure or vacuum created by said internal combustion engine;

generating an electrical sensor signal representative of said pressure or vacuum;

generating an electrical control signal to control a mechanical actuator using a logic device, said electrical control signal generated based on said electrical sensor signal and programmable response curves that are stored in a memory connected to the logic device;

controlling said positions of said reluctor plate in said distributor based on said electrical control signal by mechanically connecting said mechanical actuator, that is not a pressure or vacuum diaphragm, to said reluctor plate to position said reluctor plate in said distributor to control efficiency, power, and pollution output of said internal combustion engine.

2. The method of claim 1 wherein said method of generating an electrical control signal using said logic device comprises:

reading said electrical sensor signal; generating a logic signal based upon control data stored in said memory connected to said logic device;

transmitting said logic signal to a digital control signal generator;

generating said electrical control signal from said digital control signal generator based on said logic signal.

3. The method of claim 2 wherein said logic signal is generated by a microprocessor.

4. The method of claim 2 wherein said logic signal is generated by a state machine.

5. The method of claim 2 further comprising: using an access port, coupled to said logic device, to transfer said control data to said logic device, said control data stored in said memory on processor board of said logic device.

6. The method of claim 1 wherein said method of detecting pressure or vacuum comprises:

using a differential pressure or vacuum sensor that creates a differential sensor signal representative of a difference between two vacuums, pressures or vacuum and pressure detected by said differential pressure or vacuum sensor.

7. The method of claim 1 wherein said method of generating the electrical sensor signal comprises generating an analog sensor signal.

8. The method of claim 1 further comprising: generating a home position signal that is transmitted to a processor board of said logic device to position said mechanical actuator during start up of said internal combustion engine.

9. A system for controlling positions of a reluctor plate in a distributor for an internal combustion engine comprising:

at least one sensor that detects vacuum or pressure created by said internal combustion engine and generates sensor signals;

a memory that stores control data and programmable response curves;

a logic device, coupled to said memory, that reads said sensor signals and retrieves said programmable response curves based upon said sensor signals and said control data stored in said memory;

a digital control signal generator that generates a digital control signal based on said programmable response curve;

a mechanical actuator that is not a diaphragm, that is mechanically coupled to said reluctor plate, and that moves said reluctor plate in response to said digital control signal to control efficiency, power, and pollution output of said internal combustion engine.

10. The system of claim 9 wherein said logic device comprises:

a microprocessor.

11. The system of claim 9 wherein said logic device comprises:

a state machine.

12. The system of claim 9 wherein said memory comprises a programmable memory.

13. The system of claim 12 further comprising:

an input/output port coupled to said logic device that allows access to said memory that stores said control data so that response curves can be stored in said memory that control positioning of said reluctor plate for various sensor signals.

14. The system of claim 9 wherein said mechanical actuator is a linear digital stepper motor.

15. The system of claim 9 wherein said mechanical actuator is a servo motor.

16. The system of claim 9 wherein said mechanical actuator is a voice-coil actuator.

17. The system of claim 9 wherein said at least one sensor comprises a differential sensor that generates a differential pressure or vacuum signal.

18. The system of claim 9 further comprising:

a home position switch that generates a home position signal to position said mechanical actuator during startup of said internal combustion engine.

* * * * *